US009091464B2

(12) United States Patent
Yoon et al.

(10) Patent No.: US 9,091,464 B2
(45) Date of Patent: Jul. 28, 2015

(54) AIR CONDITIONER

(75) Inventors: Pilhyun Yoon, Changwon-si (KR); Yongcheol Sa, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 635 days.

(21) Appl. No.: 13/241,436

(22) Filed: Sep. 23, 2011

(65) Prior Publication Data

US 2012/0186295 A1 Jul. 26, 2012

(30) Foreign Application Priority Data

Jan. 21, 2011 (KR) ..... 10-2011-0006474

(51) Int. Cl.
*F25B 1/00* (2006.01)
*F25B 1/10* (2006.01)
*F25B 41/04* (2006.01)

(52) U.S. Cl.
CPC . *F25B 1/10* (2013.01); *F25B 41/04* (2013.01); *F25B 2400/0409* (2013.01); *F25B 2400/0411* (2013.01); *F25B 2400/13* (2013.01)

(58) Field of Classification Search
CPC ..... F25B 2400/73; F25B 2400/0411; F25B 40/00; F25B 39/00; F25B 41/062; F25B 41/067; F25B 6/04
USPC ..... 62/510, 513, 515, 511, 498, 222, 126
See application file for complete search history.

(56) References Cited

U.S. PATENT DOCUMENTS

| | | | | |
|---|---|---|---|---|
| 5,056,329 | A | 10/1991 | Wilkinson | |
| 6,694,750 | B1 * | 2/2004 | Lifson et al. | 62/113 |
| 2004/0035122 | A1 * | 2/2004 | Lifson et al. | 62/113 |

FOREIGN PATENT DOCUMENTS

| | | | |
|---|---|---|---|
| CN | 1847750 | A | 10/2006 |
| EP | 1965154 | | 9/2008 |
| GB | 2446062 | | 7/2008 |
| GB | 2446062 | A | 7/2008 |
| JP | S56-71141 | U | 6/1981 |
| JP | S57-184471 | U | 11/1982 |
| JP | 2002-106995 | A | 4/2002 |
| JP | 2007-255864 | | 10/2007 |
| JP | 2007-263440 | A | 10/2007 |
| JP | 2007-278686 | A | 10/2007 |
| JP | 2008-025905 | | 2/2008 |
| JP | 2008-032305 | | 2/2008 |
| JP | 2008-032336 | A | 2/2008 |
| JP | 2008-144643 | | 6/2008 |
| JP | 2008-185327 | A | 8/2008 |
| JP | 2009-300023 | | 12/2009 |
| JP | 2010-156536 | | 7/2010 |
| WO | WO 2007/111595 | | 10/2007 |
| WO | WO 2008/130359 | | 10/2008 |

* cited by examiner

*Primary Examiner* — Melvin Jones
(74) *Attorney, Agent, or Firm* — McKenna Long & Aldridge LLP

(57) ABSTRACT

An air conditioner includes a plurality of compressors, a condenser that condenses a refrigerant compressed in the plurality of the compressors, an expansion device that expands the refrigerant discharged from the condenser, and an evaporator that evaporates the refrigerant expanded in the expansion device. A first path diverges between the condenser and the evaporator to supply a portion of the refrigerant discharged from the condenser to at least one of the plurality of compressors. A second path diverges between the condenser and the evaporator to supply a portion of the refrigerant discharged from the condenser to a path between the plurality of compressors.

14 Claims, 7 Drawing Sheets

AIR CONDITIONER

This application claims the priority to Korean Application No. 10-2011-0006474, filed on Jan. 21, 2011, which is incorporated by reference, as if fully set forth herein.

FIELD OF THE DISCLOSURE

The present disclosure relates to an air conditioner, and more particularly to an air conditioner capable of improving heating ability and efficiency.

BACKGROUND

In general, an air conditioner comprises a heating apparatus, a cooling apparatus, a heat pump, an air cleaner, and etc.

The air conditioner is an apparatus that cools or heats an indoor space by performing a process of compressing, condensing, expanding and evaporating a refrigerant. Air conditioners may be classified as a general air conditioner in which a single indoor unit is connected to an outdoor unit or as a multi-air conditioner in which a plurality of indoor units are connected to an outdoor unit. The air conditioner includes a compressor, a condenser, an expanding valve and an evaporator. A refrigerant discharged from the compressor is condensed in the condenser and then expanded in the expanding valve. The expanded refrigerant is evaporated in the evaporator and then sucked back into the compressor.

In the case of an air conditioner capable of performing cooling and heating operations, when the air conditioner is in the cooling operation, an outdoor heat exchanger serves as a condenser that condenses a high-temperature and high-pressure refrigerant discharged from a compressor into a liquefied refrigerant by performing a heat exchange. An indoor heat exchanger here serves as an evaporator. When the air conditioner is in the heating operation, the outdoor heat exchanger serves as an evaporator that evaporates a refrigerant, which may be in a mixture state of gas and liquid collected from the indoor heat exchanger, into a gaseous state by performing a heat exchange. The indoor heat exchanger here serves as a condenser.

In the conventional air conditioner, when outdoor temperature rapidly falls down due to a cold wave or where low-temperature heating is performed in a cool region, evaporation pressure falls down, the suction density of the compressor is decreased, and it is difficult to obtain a mass flow rate necessary for the heating operation. Therefore, heating performance may be considerably deteriorated. In a case where the air conditioner is replaced by a large-capacity air conditioner or a new air conditioner is additionally provided, cost of installation is increased, and a space for installation needs to be secured.

SUMMARY

One aspect is to provide an air conditioner, which can prevent the deterioration of heating ability and improve heating efficiency in low-temperature heating operation.

In accordance with one aspect of the present invention, there is provided an air conditioner including a plurality of compressors, a condenser that condenses a refrigerant compressed in the plurality of the compressors, an expansion device that expands the refrigerant discharged from the condenser, an evaporator that evaporates the refrigerant expanded in the expansion device, a first path diverged between the condenser and the evaporator to supply a portion of the refrigerant discharged from the condenser to at least one of the plurality of compressors, a second path diverged between the condenser and the evaporator to supply a portion of the refrigerant discharged from the condenser to a path between the plurality of compressors.

In accordance with another aspect of the present invention, there is provided an air conditioner including a plurality compressing chambers; a condenser that condenses a refrigerant compressed in the plurality of compressing chambers; an expansion device that expands the refrigerant discharged from the condenser; an evaporator that evaporates the refrigerant expanded in the expansion device; a first path to supply the refrigerant discharged from the condenser to at least one of the plurality compressing chambers; a second path to supply the refrigerant discharged from the condenser at a position between the plurality of compressing chambers.

The air conditioner according to one or more aspects of the present invention as configured above may include a plurality of scroll compressors, and may include an internal injection path that injects a refrigerant into the interior of each of the plurality of scroll compressors and an intermediate injection path that injects the refrigerant between the plurality of scroll compressors. Thus, the refrigerant is injected through the internal injection path and the intermediate injection path according to the heating load, so that the heating ability and efficiency of the air conditioner may be enhanced through multi-stage compression and injection.

In addition, a plurality of injections are performed, so that an injection flow rate is increased, thereby enhancing the heating ability.

Since the effect of four-stage compression may be obtained using two compressors, it may be unnecessary to provide additional compressors in a cool region. Since the size of the air conditioner may be reduced, it may be possible to save cost and space for providing the air conditioner.

Since the refrigerant injection structure of the scroll compressor may be simplified, it may be easy to apply the scroll compressor to the conventional scroll compressor.

The air conditioner may include the intermediate injection path through which the refrigerant is injected between the plurality of scroll compressor, and a refrigerant path control valve is provided before the intermediate injection path is diverged. Thus, it may be easy to control the pressure of the refrigerant, thereby easily performing the injection of the refrigerant between the plurality of scroll compressors.

The internal injection valve may be provided at the internal injection path through which the refrigerant is injected into the interior of the scroll compressor, so that it may be possible to control the superheat of the injected refrigerant.

DETAILED DESCRIPTION OF THE EXEMPLARY EMBODIMENTS

Figure 1:
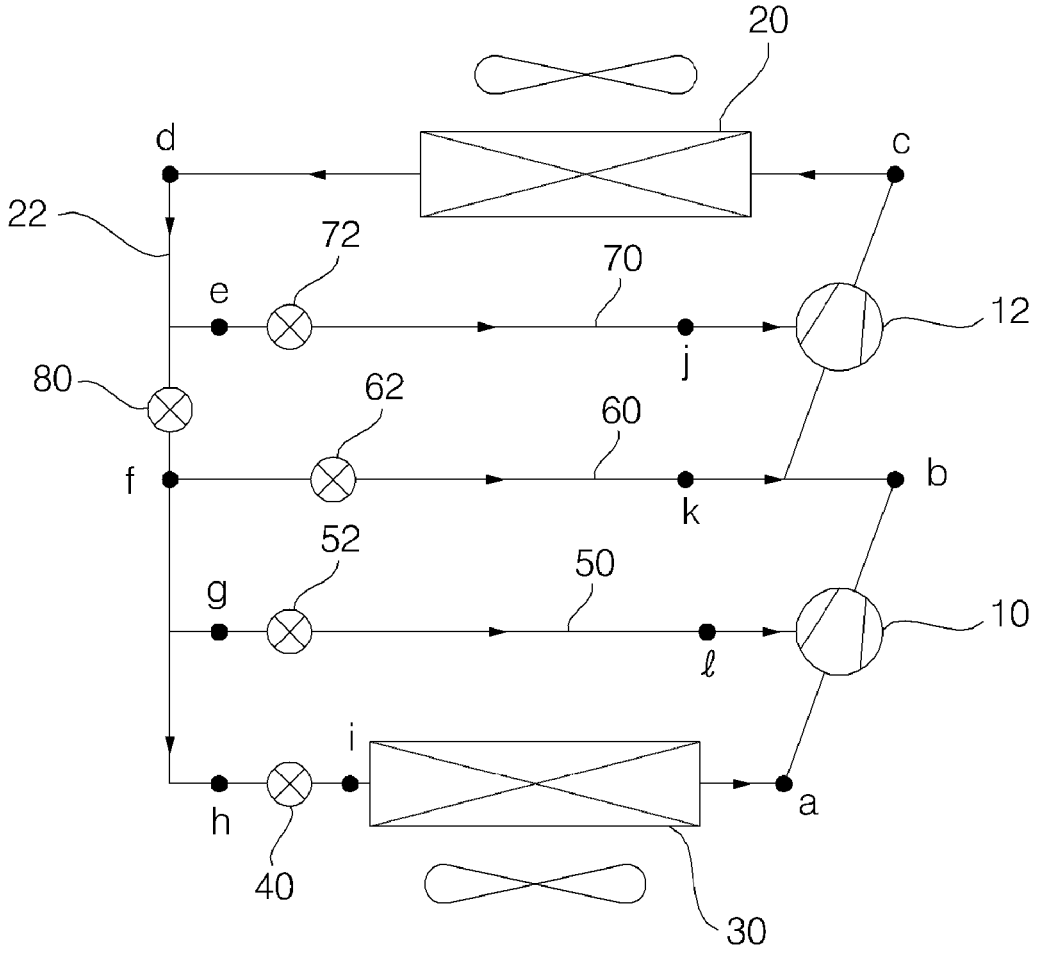
FIG. 1 is a schematic diagram illustrating a configuration of an air conditioner according to an embodiment of the present invention.

Hereinafter, exemplary embodiments of the present invention will be described in detail with reference to the accompanying drawings. However, the present invention is not limited to the embodiments but may be implemented into different forms. These embodiments are provided only for illustrative purposes and for understanding the present invention by those skilled in the art. Throughout the drawings, like elements are designated by like reference numerals.

Figure 2:
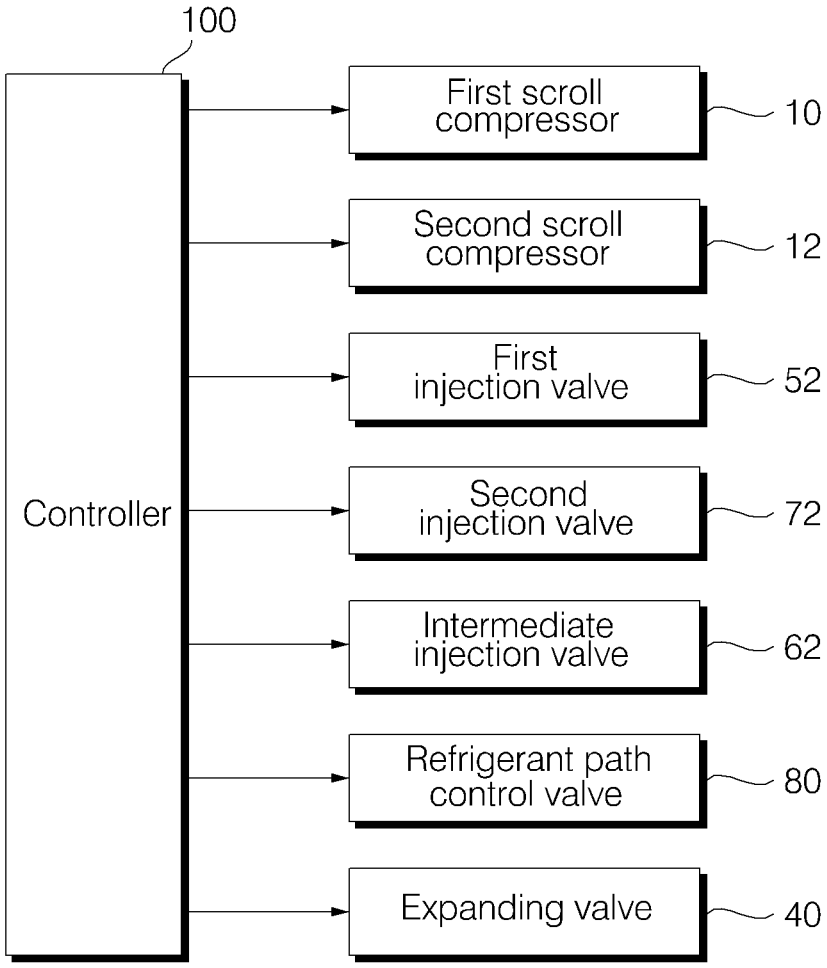
FIG. 2 is a block diagram illustrating a control flow of the air conditioner according to the embodiment of the present invention.
Figure 3:
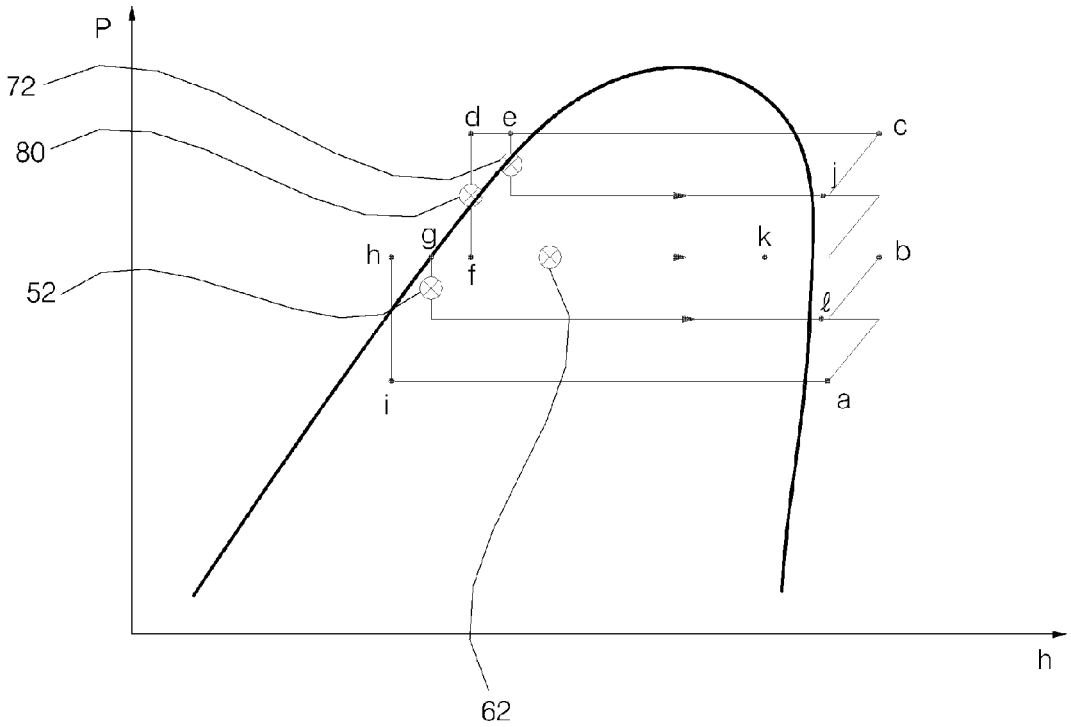
FIG. 3 is a Mollier diagram (P-H diagram) illustrating a cooling cycle of the air conditioner shown in FIG. 1.

FIG. 1 is a schematic diagram illustrating a configuration of an air conditioner according to an embodiment of the present invention. FIG. 2 is a block diagram illustrating a control flow of the air conditioner according to the embodiment of the present invention. FIG. 3 is a Mollier diagram (P-H diagram) illustrating a cooling cycle of the air conditioner shown in FIG. 1.

Referring to FIG. 1, the air conditioner according to the embodiment of the present invention includes a plurality of scroll compressors 10 and 12, a condenser 20 that condenses a refrigerant compressed in the scroll compressors 10 and 12, an expansion device 40 that expands the refrigerant discharged from the condenser 20, and an evaporator 30 that evaporates the refrigerant expanded in the expansion device 40. The air conditioner further includes internal injection paths 50 and 70 diverged between the condenser 20 and the evaporator 30 to inject a portion of the refrigerant discharged from the condenser 20 into the interior of at least one of the plurality of scroll compressors 10 and 12, and an intermediate injection path 60 diverged between the condenser 20 and the evaporator 30 to inject a portion of the refrigerant discharged from the condenser 20 into paths between the plurality of scroll compressors 10 and 12.

In this embodiment, the plurality of scroll compressors 10 and 12 includes a first scroll compressor 10 and a second scroll compressor 12 connected in series to the first scroll compressor 10 to compress the refrigerant discharged from the first scroll compressor 10. However, the present invention is not limited thereto, and the plurality of scroll compressors may include three or more compressors.

Each of the first and second scroll compressors 10 and 12 includes an orbiting scroll and a fixing scroll in the interior thereof, and the refrigerant in a compression chamber is compressed according to the orbiting motion of the orbiting scroll.

The first scroll compressor 10 and the second scroll compressor 12 may have connection ports formed to be connected to the internal injection paths 50 and 70, respectively.

The refrigerant path 22 connects between the condenser 20 and the evaporator 30. The internal injection paths 50 and 70 include a first injection path 50 diverged from one side of a refrigerant path 22 and connected to the first scroll compressor 10, and a second injection path 70 diverged from the other side of the refrigerant path 22 and connected to the second scroll compressor 12.

Since the plurality of scroll compressors in this embodiment is limited to the first and second scroll compressors 10 and 12, the internal injection paths 50 and 70 are configured as two paths through which the refrigerant is injected into the interior of each of the first and second scroll compressors 10 and 12.

The first injection path 50 guides a portion of the refrigerant discharged from the condenser 20 to be injected into the interior of the first scroll compressor 10.

The second injection path 70 guides a portion of the refrigerant discharged from the condenser 20 to be injected into the interior of the second scroll compressor 12.

A first injection valve 52 that controls an amount of the refrigerant passing through the first injection path 50 may be provided to the first injection path 50. The first injection valve 52 may control the degree of opening according to the superheat of the refrigerant injected through the first injection path 50.

A second injection valve 72 that controls an amount of the refrigerant passing through the second injection path 70 may be provided to the second injection path 70. The second injection valve 72 may control the degree of opening according to the superheat of the refrigerant injected through the second injection path 70.

A first gas/liquid separator (not shown) that separates the refrigerant into gaseous and liquefied states may be provided at a point at which the first injection path 50 is diverged from the refrigerant path 22.

A second gas/liquid separator (not shown) that separates the refrigerant into gaseous and liquefied states may be provided at a point at which the second injection path 70 is diverged from the refrigerant path 22.

The present invention is not limited thereto, and an economizer may be used rather than the gas/liquid separator.

The intermediate injection path 60 is diverged from the refrigerant path 22 so as to guide a portion of the refrigerant discharged from the condenser 20 to be injected between the first and second scroll compressors 10 and 12.

An intermediate injection valve 62 that controls an amount of the refrigerant passing through the intermediate injection path 60 may be provided to the intermediate injection path 60. The intermediate injection valve 62 may be used to control the discharge temperature of the second scroll compressor 12. That is, the intermediate injection valve 62 may control the degree of opening according to the discharge temperature of the second scroll compressor 12.

A refrigerant path control valve 80 may be provided at a position before the intermediate injection path 60 is diverged from the refrigerant path 22. The refrigerant path control valve 80 may control the degree of opening so that the difference between the pressures of the refrigerant injected through the intermediate injection path 60 and the refrigerant discharged from the first scroll compressor 10 is within a set range.

The air conditioner further includes a controller 100 that controls the degrees of openings of the first injection valve 52, the second injection valve 72, the intermediate injection valve 62 and the refrigerant path control valve 80.

The controller 100 may selectively open at least one of the first injection valve 52, the second injection valve 72 and the intermediate injection valve 62 according to the heating load.

The controller 100 may sequentially open the first injection valve 52, the intermediate injection valve 62 and the second injection valve 72 as the heating load is increased. For instance, in a case where the heating load is small, the controller 100 may open only the first injection valve 52 and close the intermediate injection valve 62 and the second injection valve 72. If the heating load is increased, the controller 100 may open the first injection valve 52 and the intermediate injection valve 62, and close the second injection valve 72. If the heating load is increased more, the controller 100 uses all the injection paths by opening the first injection valve 52, the intermediate injection valve 62 and the second injection valve 72, so that it is possible to enhance the heating ability of the air conditioner by corresponding with the heating load.

The operation of the air conditioner according to the embodiment of the present invention described above will now be described.

The controller 100 may selectively use the first injection path 50, the second injection path 70 and the intermediate injection path 60.

Referring to FIG. 1, in a case where the outdoor temperature is very low and the heating load is large, the controller 100 may use the first injection path 50 and the second injection path 70 and the intermediate injection path 60.

Referring to FIGS. 1 and 3, the refrigerant 'a' sucked into the first scroll compressor 10 is mixed with the gaseous refrigerant 'l' flowing through the first injection path 50, and the mixed refrigerant is then compressed. The superheat of the gaseous refrigerant 'l' injected through the first injection path 50 may be controlled according to the degree of opening of the first injection valve 52.

The refrigerant 'b' compressed and discharged from the first scroll compressor 10 is mixed with the refrigerant 'k' injected through the intermediate injection path 60, and the mixed refrigerant is then sucked into the second scroll compressor 12.

The refrigerant sucked into the second scroll compressor 12 is mixed with the gaseous refrigerant 'j' flowing through the second injection path 70, and the mixed refrigerant is then compressed. The superheat of a gaseous refrigerant 'j' injected through the second injection path 70 may be controlled according to the degree of opening of the second injection valve 72.

The refrigerant 'c' compressed and discharged from the second scroll compressor 12 is condensed while passing through the condenser 20. The condenser 20 is an indoor heat exchanger, and heats indoor air through a heat exchange between the refrigerant and the indoor air.

The amount of the refrigerant flowing into the condenser 20 is obtained by adding the amount of the refrigerant sucked into the first scroll compressor 10 to the amount of the refrigerant injected through the first injection path 50, the amount of the refrigerant injected through the intermediate injection path 60 and the amount of the refrigerant injected through the second injection path 70. As the amount of the refrigerant flowing into the condenser 20 is increased, the heating ability and efficiency of the air conditioner can be enhanced.

The refrigerant discharged from the condenser 20 is injected into the interior of the second scroll compressor 12 via the second injection valve 72 and the second injection path 70.

The controller 100 may control the superheat of the refrigerant injected through the second injection path 70 by controlling the degree of opening of the second injection valve 72.

Of the refrigerant discharged from the condenser, the refrigerant not injected into the second injection path 70 may be injected between the first and second scroll compressors 10 and 12 through the intermediate injection path 60.

The controller 100 may control the degree of opening of the refrigerant path control valve 80 so that the pressure difference (Pf–Pb) between the refrigerant 'f' injected through the intermediate injection path 60 and the refrigerant 'b' discharged from the first scroll compressor 10 is within a set range. In order to inject the refrigerant between the first and second scroll compressors 10 and 12, the controller 100 may control the degree of opening of the refrigerant path control valve 80 so that the pressure difference between the refrigerant injected through the intermediate injection path 60 and the refrigerant discharged from the first scroll compressor 10 is constant.

The controller 100 may control the amount of the refrigerant injected through the intermediate injection path 60 and the discharge temperature of the second scroll compressor 12 by controlling the degree of opening of the intermediate injection valve 62.

Of the refrigerant discharged from the condenser 20, the refrigerant not injected into the intermediate injection path 60 may be injected into the interior of the first scroll compressor 10 through the first injection path 50.

The controller 100 may control the superheat of the refrigerant injected through the first injection path 50 by controlling the degree of opening of the first injection valve 52.

As described above, in a case where the heating load is large, the refrigerant is injected through the first injection path 50, the intermediate injection path 60 and the second injection path 70, so that it is possible to obtain the effect of multi-stage compression as shown in FIG. 3 and to enhance the heating ability and efficiency of the air conditioner.

Figure 4:
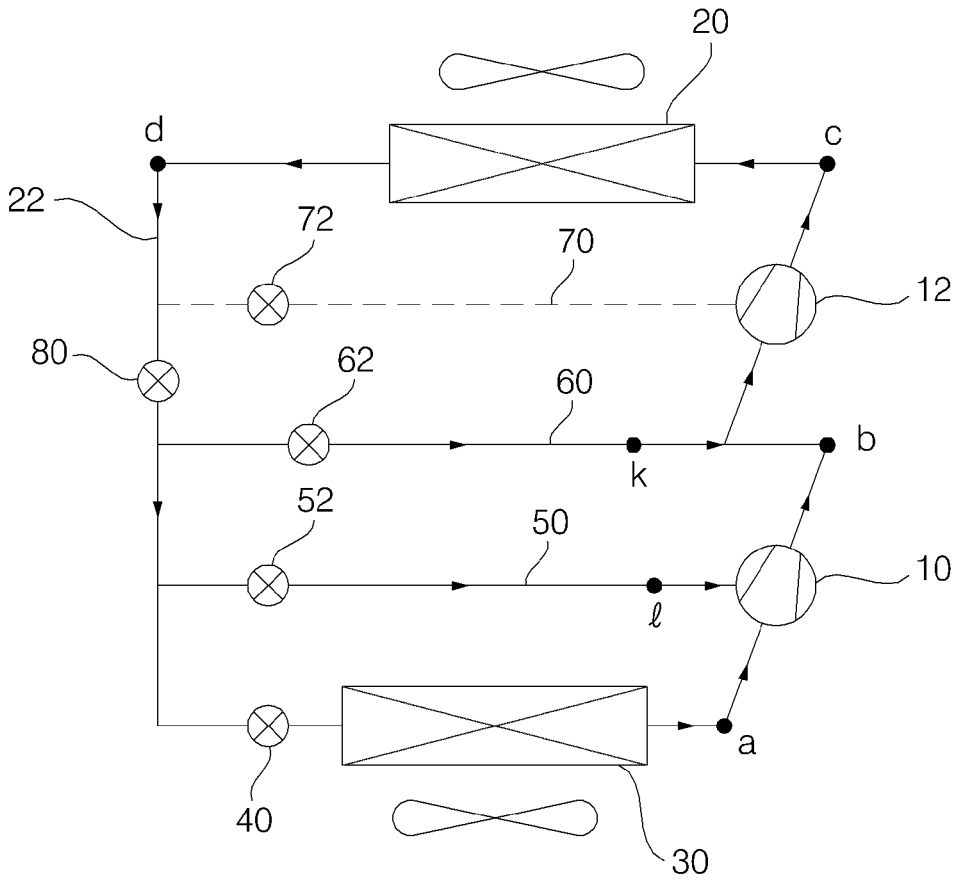
FIG. 4 is a schematic diagram illustrating the flow of a refrigerant when the heating load of the air conditioner is small according to the embodiment of the present invention.
Figure 5:
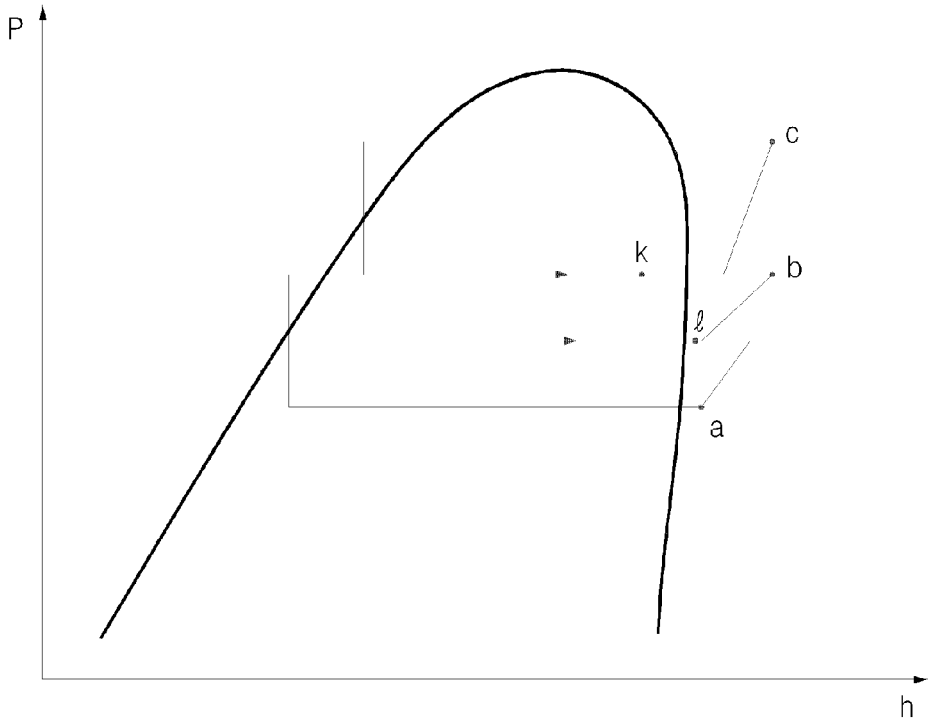
FIG. 5 is a Mollier diagram illustrating a cooling cycle of the air conditioner shown in FIG. 4.

FIG. 4 is a view illustrating the flow of a refrigerant when the heating load of the air conditioner is small according to the embodiment of the present invention. FIG. 5 is a Mollier diagram illustrating a cooling cycle of the air conditioner shown in FIG. 4.

Referring to FIG. 4, in a case where the heating load is small, the controller 100 may selectively use at least one of the first injection path 50, the second injection path 70 and the intermediate injection path 60.

In this embodiment, it will be described based on that the controller 100 uses the first injection path 50 and the intermediate injection path 60, and does not use the second injection path 70 by closing the second injection valve 72.

In a case where a plurality of compressors is used and a plurality of injections is possible, it is preferable in terms of efficiency that the injection to a high-pressure side is not used. In this embodiment, it will be described based on that the second injection path 70 through which the refrigerant is injected into the interior of the second scroll compressor 12 is not used.

The refrigerant 'a' sucked into the first scroll compressor 10 is mixed with the refrigerant 'l' flowing through the first injection path 50, and the mixed refrigerant is then compressed.

The refrigerant 'b' compressed and discharged from the first scroll compressor 10 is mixed with the refrigerant 'k' injected through the intermediate injection path 60, and the mixed refrigerant is then sucked into the second scroll compressor 12.

The refrigerant sucked into the second scroll compressor 12 is compressed in the second scroll compressor 12 and then discharged from the second scroll compressor 12. The second injection valve 72 is closed, so that the injection of the refrigerant through the second injection path 70 is prevented.

The amount of refrigerant flowing into the condenser 20 is obtained by adding the amount of the refrigerant sucked into the first scroll compressor 10 to the amount of the refrigerant injected through the first injection path 50 and the amount of the refrigerant injected through the intermediate injection path 60.

As described above, since the controller 100 selectively opens/closes the second injection valve 72 according to the heating load, it is easy to deal with the heating load.

In a case where no additional flow of refrigerant is needed according to the heating load, the controller 100 may close the first and second injection valves 52 and 72, and may also close the intermediate injection valve 62.

In the exemplary embodiment of the present invention, it is described that the air conditioner comprises a plurality of scroll compressors. But, it is possible that the air conditioner comprises a compressing chamber for compressing a refrigerant. The compressing chamber is variously embodied by those of ordinary skill in the scope of the present invention.

Figure 6:
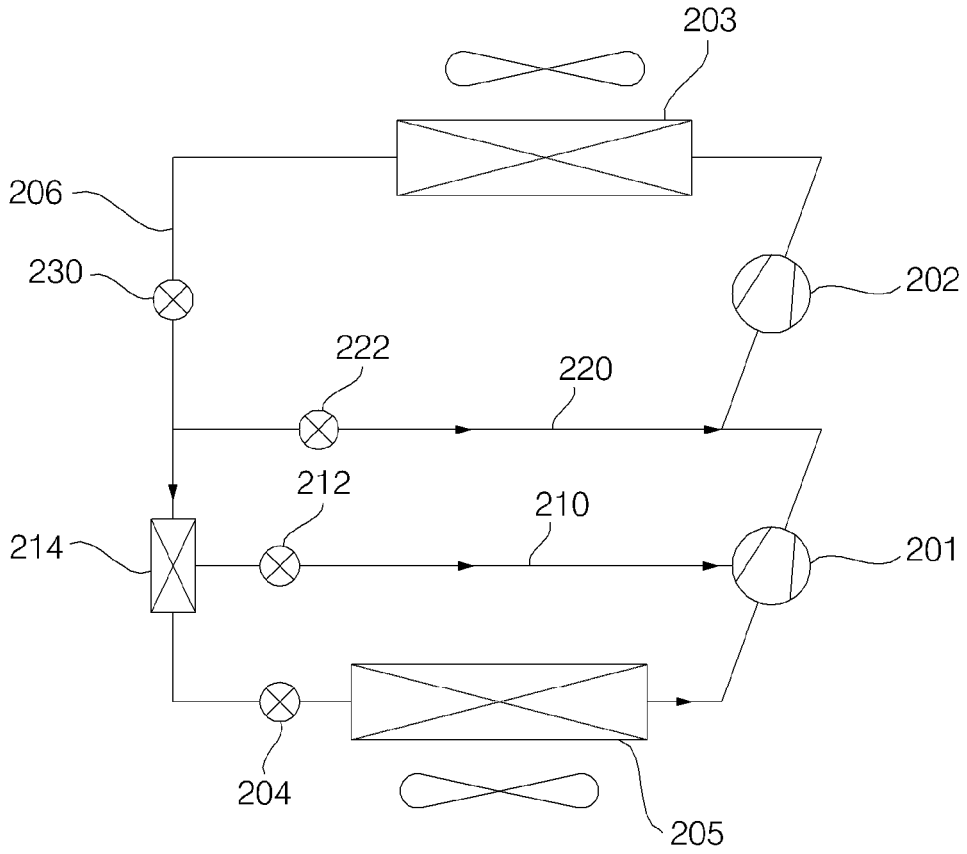
FIG. 6 is a schematic diagram illustrating a configuration of an air conditioner according to another embodiment of the present invention.

FIG. 6 is a schematic diagram illustrating a configuration of an air conditioner according to another embodiment of the present invention.

Referring to FIG. 6, the air conditioner according to the embodiment of the present invention includes a first scroll compressor 201, a second scroll compressor 202 connected in series to the first scroll compressor 201, a condenser 203 that condenses a refrigerant compressed in the second scroll compressor 202, an expansion device 204 that expands the refrigerant condensed in the condenser 203, and an evaporator 205 that evaporates the refrigerant expanded in the expansion device 204.

The air conditioner further includes a first injection part for injecting the refrigerant discharged from the condenser 203 into at least one of the plurality of scroll compressors and a second injection part for injecting the refrigerant discharged from the condenser 203 into a place between the plurality of scroll compressors.

The first injection part may comprise a plurality of flow path for injecting the refrigerant into the plurality of scroll compressors respectively. Also, it is possible that the first injection part may comprises a plurality of flow path for injecting the refrigerant a scroll compressor.

In the exemplary embodiment of the present invention, the first injection part comprises an internal injection path 210 that injects the refrigerant discharged from the condenser 203 into the interior of the first scroll compressor 201.

The second injection part comprises an intermediate injection path 220 that injects a portion of the refrigerant discharged from the condenser 203 between the first and second scroll compressors 201 and 202.

The components and operations of this embodiment are identical to those in the aforementioned embodiment, except that only one intermediate injection path 220 and only one internal injection path 210 are formed. Therefore, their detailed descriptions will be omitted.

The first injection part further comprises an internal injection valve 212 that is provided to the internal injection path 210. The internal injection valve 212 may control an amount of the refrigerant passing through the internal injection path 210.

The second injection part further comprises an intermediate injection valve 222 that may control the amount of the refrigerant passing through the intermediate injection path 220. The intermediate injection valve 222 is provided to the intermediate injection path 220.

A refrigerant path control valve 230 may be provided on a refrigerant path that connects the condenser 203 and the expansion device 204.

In the air conditioner configured as describe above, a gaseous refrigerant is injected into the interior of the first scroll compressor 201, and a refrigerant is injected in a path between the first and second scroll compressors 201 and 202. Thus, it has the effect of multi-stage compression. As the multi-stage compression is performed, the compression rate is increased, and the discharge temperature of the second scroll compressor 202 is decreased, so that it is possible to enhance the ability of the compressor regardless of the discharge temperature.

Figure 7:
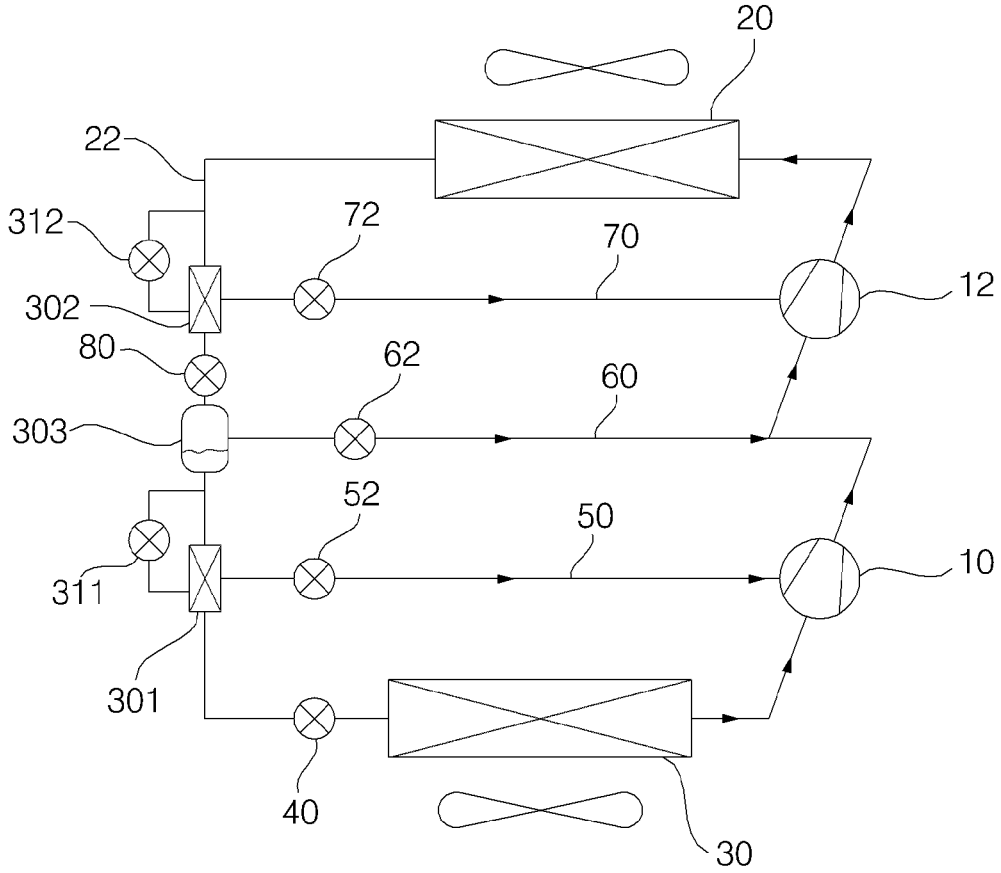
FIG. 7 is a schematic diagram illustrating a configuration of an air conditioner according to another embodiment of the present invention.

FIG. 7 is a schematic diagram illustrating a configuration of an air conditioner according to another embodiment of the present invention.

Referring to FIG. 7, the air conditioner according to the another embodiment of the present invention includes a heat exchanger 301 and 302 such as an economizer and a phase separator 303. The components and operations of this embodiment are identical to those in the aforementioned embodiment, except that the heat exchanger and the phase separator are disposed. Therefore, the detailed descriptions about the same components will be omitted.

The heat exchanger comprises a first heat exchanger 301 disposed between the refrigerant path 22 and the first injection path 50 and a second heat exchanger 302 disposed between the refrigerant path 22 and the second injection path 70.

The portion of the refrigerant discharged from the condenser 20 flows to a second control valve 312 and is controlled by the second control valve 312. The refrigerant passing through the second control valve 312 exchanges heat with the refrigerant passing through the refrigerant path 22 in the second heat exchanger 302. Thus, the refrigerant absorbs the heat in the second heat exchanger 302 and becomes a gaseous state or mixture state. The gaseous refrigerant or mixture refrigerant may be injected into the second scroll compressor 12.

The refrigerant passing through the refrigerant control valve 80 flow to the phase separator 303. The gaseous refrigerant separated by the phase separator 303 passes through the intermediate injection path 60.

In addition, the refrigerant flowing through the first injection path 50 is supplied from the first heat exchanger 301 and a first control valve 311.

Thus, a liquid refrigerant being injected into the first scroll compressor 10 and the second compressor 12 may be minimized.

The position of the first heat exchanger 301, the second heat exchanger 302 and the phase separator 303 is not limited thereto. The phase separator 303 can be disposed at the place that diverges to the first injection path 50 or the second injection path 70. Also, the heat exchanger 301 and 302 can be disposed at the place that diverges to the intermediate injection path.

The invention has been explained above with reference to exemplary embodiments. It will be evident to those skilled in the art that various modifications may be made thereto without departing from the broader spirit and scope of the invention. Further, although the embodiments have been described in the context of its implementation in particular environments and for particular applications, those skilled in the art will recognize that the present invention's usefulness is not limited thereto and that the invention can be beneficially utilized in any number of environments and implementations. The foregoing description and drawings are, accordingly, to be regarded in an illustrative rather than a restrictive sense.

What is claimed is;:

1. An air conditioner comprising:

a plurality of compressors;

a condenser that condenses a refrigerant compressed in the plurality of the compressors;

an expansion device that expands the refrigerant discharged from the condenser;

an evaporator that evaporates the refrigerant expanded in the expansion device;

a first path diverged between the condenser and the evaporator to supply a portion of the refrigerant discharged from the condenser to at least one of the plurality of compressors; and a second path diverged between the condenser and the evaporator to supply a portion of the refrigerant discharged from the condenser to a path between the plurality of compressors; and a controller that controls an amount of the refrigerant passing through the first path and the second path based on a heating load, wherein the plurality of compressors comprise a first compressor and a second compressor connected in series to the first compressor to compress the refrigerant discharged from the first compressor, wherein the first path comprises a third path to supply a portion of the refrigerant discharged from the condenser to the first compressor, and a fourth path to supply a portion of the refrigerant discharged from the condenser to the second compressor.

2. The air conditioner of claim 1, wherein the second path supplies a portion of the refrigerant discharged from the condenser at a position between the first and second compressors.

3. An air conditioner comprising:

a plurality of compressors;

a condenser that condenses a refrigerant compressed in the plurality of the compressors;

an expansion device that expands the refrigerant discharged from the condenser;

an evaporator that evaporates the refrigerant expanded in the expansion device;

a first path diverged between the condenser and the evaporator to supply a portion of the refrigerant discharged from the condenser to at least one of the plurality of compressors;

a second path diverged between the condenser and the evaporator to supply a portion of the refrigerant discharged from the condenser to a path between the plurality of compressors;

a refrigerant path control valve provided at a position before the second path diverged between the condenser and the evaporator; and a controller which controls a degree of opening of the refrigerant path control valve so that a pressure difference between the refrigerant supplied through the second path and the refrigerant discharged from a compressor is within a set range.

4. The air conditioner of claim 1, further comprising a first valve provided at the first path to control an amount of the refrigerant passing through the first path.

5. The air conditioner of claim 4, further comprising;

a controller which controls a degree of opening of the first valve based on a superheat of the refrigerant supplied through the first path.

6. The air conditioner of claim 1, further comprising a second valve provided at the second path.

7. The air conditioner of claim 6, further comprising;

a controller which controls a degree of opening of the second valve based on a discharge temperature of a compressor.

8. An air conditioner comprising:

a plurality of compressors;

a condenser that condenses a refrigerant compressed in the plurality of the compressors;

an expansion device that expands the refrigerant discharged from the condenser;

an evaporator that evaporates the refrigerant expanded in the expansion device;

a first path diverged between the condenser and the evaporator to supply a portion of the refrigerant discharged from the condenser to at least one of the plurality of compressors;

a second path diverged between the condenser and the evaporator to supply a portion of the refrigerant discharged from the condenser to a path between the plurality of compressors;

a first valve provided at the first path to control an amount of the refrigerant;

a second valve provided at the second path; and a controller which opens at least one of the first valve and the second valve based on the heating load.

9. The air conditioner of claim 8, wherein the controller sequentially opens the first valve and the second valve as the heating load is increased.

10. The air conditioner of claim 8, further comprising a refrigerant path control valve provided at a position before the second path is diverged between the condenser and the evaporator, wherein the controller controls a degree of opening of the refrigerant path control valve so that the pressure difference between the refrigerant supplied through the second path and the refrigerant discharged from the compressor is within a set range.

11. The air conditioner of claim 8, wherein the controller controls a degree of opening of the first valve based on the superheat of the refrigerant supplied through the first path.

12. The air conditioner of claim 8, wherein the controller controls a degree of opening of the second valve based on a discharge temperature of the compressor.

13. An air conditioner comprising:

a plurality compressing chambers;

a condenser that condenses a refrigerant compressed in the plurality of compressing chambers;

an expansion device that expands the refrigerant discharged from the condenser;

an evaporator that evaporates the refrigerant expanded in the expansion device;

a first path to supply the refrigerant discharged from the condenser to at least one of the plurality compressing chambers; and a second path to supply the refrigerant discharged from the condenser at a position between the plurality of compressing chambers, wherein the first path comprises a plurality of flow paths to supply the refrigerant into the plurality compressing chambers, respectively, wherein a valve is disposed on at least one of the first path and the second path to control an amount of the refrigerant supplied through the at least one of the first path and the second path based on the heating load.

14. The air conditioner of claim 13, wherein the second path comprises a plurality of flow paths to supply the refrigerant between two of the plurality compressing chambers.

* * * * *